US008540535B2

(12) United States Patent
Martens et al.

(10) Patent No.: US 8,540,535 B2
(45) Date of Patent: Sep. 24, 2013

(54) CABLE LUG WITH SHELL-SHAPED PART AND FASTENING DEVICE

(75) Inventors: Sebastian Martens, Straelen (DE); Martin Schloms, Aachen (DE); Franz-Josef Lietz, Oberhausen-Lirich (DE)

(73) Assignee: Auto Kabel Managementgesellschaft mbH, Hausen i.W. (DE)

( * ) Notice: Subject to any disclaimer, the term of this patent is extended or adjusted under 35 U.S.C. 154(b) by 0 days.

(21) Appl. No.: 13/520,276

(22) PCT Filed: Oct. 26, 2010

(86) PCT No.: PCT/EP2010/066097

§ 371 (c)(1),
(2), (4) Date: Jul. 2, 2012

(87) PCT Pub. No.: WO2011/091873

PCT Pub. Date: Aug. 4, 2011

(65) Prior Publication Data

US 2012/0279748 A1 Nov. 8, 2012

(30) Foreign Application Priority Data

Jan. 26, 2010 (DE) ..... 10 2010 005 841

(51) Int. Cl.
*H01R 4/18* (2006.01)

(52) U.S. Cl.
USPC ..... 439/866; 439/879

(58) Field of Classification Search
USPC ..... 439/865–868, 879, 882, 883, 891
See application file for complete search history.

(56) References Cited

U.S. PATENT DOCUMENTS 1,539,962 A * 6/1925 Seufert et al. ..... 439/796
2,644,929 A * 7/1953 Kumpf ..... 333/263

(Continued)

FOREIGN PATENT DOCUMENTS

DE 10340284 3/2004
DE 102006009035 9/2006

(Continued)

OTHER PUBLICATIONS

International Searching Authority, International Search Report—International Application No. PCT/EP2010/066097, dated Dec. 20, 2010, together with the Written Opinion of the International Searching Authority, 12 pages.

(Continued)

*Primary Examiner* — Tho D Ta
(74) *Attorney, Agent, or Firm* — Sunstein Kann Murphy & Timbers LLP

(57) ABSTRACT

The invention relates to a method and a system for fastening a round conductor 200 to a connection element 100, 100', 100", comprising a connection element 100, 100', 100" that comprises at one end an at least partially shell-shaped part 110, and a round conductor 200 closed with a contact element 210, the contact element 210 being adapted to contact the connection element 100, 100', 100", and a fastening device 400, 510, 520, 610, 620, 660, 710, 810, which is adapted to fasten in a frictional manner (force-fit) an end region 210 of the round conductor 200 lying in front of the contact element 210 in the region of the shell-shaped part 110 of the connection element 100, 100', 100", to the connection element 100, 100', 100".

24 Claims, 10 Drawing Sheets

(56) References Cited

U.S. PATENT DOCUMENTS

Figure 1:
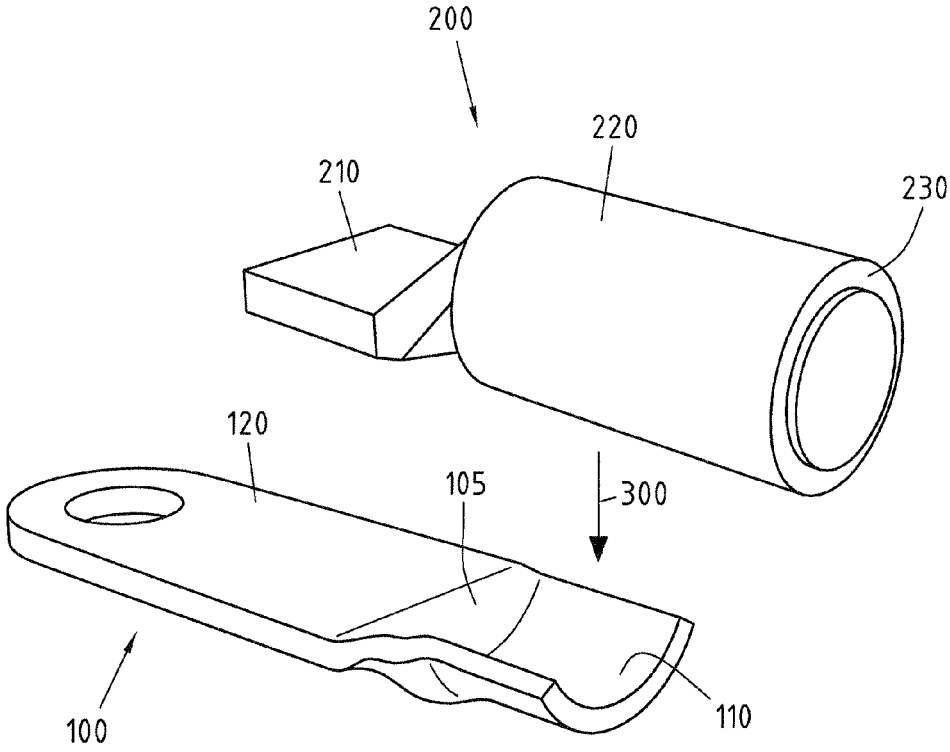

| | | | | |
|---|---|---|---|---|
| 7,048,562 | B2 | 5/2006 | Lutsch et al. | 439/275 |
| 7,249,970 | B1 * | 7/2007 | Wei | 439/585 |
| 7,338,334 | B2 | 3/2008 | Kumakura | 439/866 |
| 7,828,610 | B2 | 11/2010 | Lehmann et al. | 439/874 |
| 2004/0088857 | A1 | 5/2004 | Fujimoto et al. | 29/871 |
| 2009/0229880 | A1 | 9/2009 | Watanabe | 174/72 A |

FOREIGN PATENT DOCUMENTS

| | | |
|---|---|---|
| EP | 1117149 | 7/2001 |
| EP | 1617517 | 1/2006 |
| EP | 2053705 | 4/2009 |
| EP | 2141771 | 1/2010 |
| WO | WO 2009/112881 A1 * | 9/2009 |

OTHER PUBLICATIONS

German Patent Office, In German—Office Action, Application No. 102010005841.6-34, dated Aug. 10, 2010, 5 pages.

German Patent Office, English Translation—Office Action, Application No. 102010005841.6-34, dated Aug. 10, 2010, 7 pages.

* cited by examiner

CABLE LUG WITH SHELL-SHAPED PART AND FASTENING DEVICE

The invention relates to a system for fastening a round conductor to a connection element with a fastening device. The invention also relates to a method for fastening a round conductor to a connection element with a fastening device.

The connection of round conductors to connection elements, which in practice are often formed flat, is as a rule difficult. On the one hand a reliable electrical contact of the round cable with the connection element must be ensured, and on the other hand this electrical contact must also be guaranteed if for example vibrations or impacts act on the connection element.

This object is achieved according to the invention by a system for fastening a round conductor to a connection element, comprising a connection element that has at one end an at least partially shell-shaped part, a round conductor closed by a contact element, the contact element being adapted for contacting the connection element, and a fastening device that is adapted to fasten an end region of the round conductor, lying in front of the contact element, in the region of the shell-shaped part of the connection element to the said connection element by frictional force (force-fit).

This object is furthermore achieved by a method for fastening a round conductor closed with a contact element to a connection element, wherein the contact element is adapted to contact the connection element and the connection element comprises at one end an at least partially shell-shaped part, by means of a fastening device, comprising positioning an end region of the round conductor, lying in front of the contact element, in the shell-shaped part of the connection element and fastening the end region of the round conductor by frictional force (force-fit) to the connection element in the region of the shell-shaped part of the connection element by means of a fastening device.

The at least partially shell-shaped part is designed so that a suitably corresponding part of an end region of the round conductor lying in front of the contact element can be accommodated when the end region of the round conductor is positioned in the at least partially shell-shaped part of the connection element. The connection element may for example be designed in one piece. The connection element may for example form a cable lug for accommodating the round cable.

The fastening device is adapted so as to fasten the end region of the round conductor lying in front of the contact element in the region of the shell-shaped part of the connection element to the connection element by frictional force (force-fit). For example, an underneath side of the round conductor in the end region is connected to the shell-shaped part of the connection element by frictional force (force-fit) by means of the fastening device. The fastening device can for example be formed so as to be reversible, in other words the fastening can be released and then be used as a fastening device again, or the fastening device can also be designed to be irreversible, in other words after fastening has been effected the friction type (force-fit) fastening remains in place.

Due to the frictional type (force-fit) fastening of the end region of the round conductor to the connection element in the region of the shell-shaped part of the connection element, on the one hand a secure fastening of the round conductor to the connection element is achieved, and on the other hand the contact element is brought into a predefined position in relation to the connection element and is held in this predefined position by the frictional type (force-fit) fastening. A simple electrical contact of the contact element with the connection element can thus take place.

The connection element may for example be a connection element for a motor vehicle electrical circuit, in which a round conductor is to be connected to the electrical circuit via the connection element. The connection element may for example be formed substantially flat except for the shell-shaped part. The cross-section of the shell-shaped part of the connection element may for example be configured substantially C-shaped, U-shaped or V-shaped.

The connection element may for example consist of aluminium or of copper or of some other conducting material, for example an alloy. The round cable may for example consist of aluminium or of copper or of some other conducting material, for example an alloy.

For example the round cable may be a copper round cable, the contact element may be formed from aluminium or from copper, and the connection element may be formed from copper or aluminium. Furthermore, the contact element may additionally be joined to the connection element by adhesive bonding (material bond). The adhesive bonding (material bond) can be produced for example between a contact element formed from aluminium and a connection element formed from copper, or between a contact element formed from copper and a connection element formed from aluminium. Thus, a copper/aluminium connection can be produced between the contact element and the connection element. The contact element and the connection element may however also be formed from the same material, for example copper or aluminium.

The fastening device may be any suitable fastening device for the afore-described frictional type (force-fit) connection with the connection element in the shell-shaped part.

According to an advantageous embodiment it is proposed that the fastening device at least partially surrounds the round conductor in the end region.

The fastening device may for example be positioned at least partly around the end region of the round conductor and an underneath side of the shell-shaped part of the connection element, so that the end region of the round conductor and the underneath side of the shell-shaped part of the connection element is at least partially surrounded by the fastening device, whereby the fastening device exerts a force on the round conductor in the end region so that the round conductor in the end region is pressed into the shell-shaped part of the connection element.

The fastening device may for example also be formed together with the shell-shaped part of the connection element, for example by a fastening segment that together with the shell-shaped part at least partially surrounds the end region of the round conductor and produces the frictional type (force-fit) connection. The fastening segment may for this purpose be joined to the shell-shaped part, for example by snap-in engagement, by adhesive bonding (material bond), or by another suitable connection.

For example, the fastening device may be shaped to be substantially annular, the annular fastening device being positioned for example at least partially around the end region of the round conductor and an underneath side of the shell-shaped part of the connection element, whereby the annular fastening device exerts a force on the round conductor in the end region so that the round conductor in the end region is pressed into the shell-shaped part of the connection element.

The fastening device may for example be a ring, which can be formed for example in one piece, two pieces or a plurality of pieces. The one-piece ring may for example be formed as a closed ring, which for example by pressing or by a spring metal exerts the force for the frictional type (force-fit) fastening. The one-piece ring may however also be formed so it can be closed on one side, in which for example snap-in elements can be provided for the snap-in engagement of this closable side. The two-piece or multipiece ring may also embrace snap-in elements for the snap-in engagement of the individual parts of the ring.

In addition the annular fastening device may for example be formed together with the shell-shaped part of the connection element, wherein for example a shell-shaped ring segment together with the shell-shaped part surrounds the end region of the round conductor and produces the frictional type (force-fit) fastening.

The term ring is not restricted in that only circular rings are to be understood by this term, but also other, substantially annular configurations are understood by the term ring.

According to an advantageous embodiment it is proposed that the contact element is formed as a flat part and that the connection element in the region of the contact area be formed as a flat part.

According to an advantageous embodiment it is proposed that the shell-shaped part is formed in such a way as to fix the round conductor in the transverse direction.

The connection element can for example in a transition region between the shell-shaped part and the contact area for the contact element have a step or edge or wall, which delimits the shell-shaped part in the transverse direction of the round cable inserted into the shell-shaped part. The end of the end region of the round cable can thus be fixed in the transverse direction by means of this step or edge or wall, when the round cable in the end region is inserted into the shell-shaped part.

According to an advantageous embodiment it is proposed that the round conductor in the end region has an insulation. The round conductor can also have an insulation in the other regions that are not associated with the end region.

According to an advantageous embodiment it is proposed that the insulation of the round conductor is stripped in a region in which the round conductor, in the case where the conductor is fastened by the fastening device, abuts against the shell-shaped part of the connection element. Thus for example edge regions of the shell-shaped part adjoin the remaining insulation in the end region of the round conductor. In this way for example a flush transition from the insulation in the end region of the round conductor to the shell-shaped part can be achieved. For example, the underneath side of the shell-shaped part can be configured so that the underneath side and the remaining insulation in the end region of the round conductor have a substantially circular cross-section. Thus, the round conductor with the stripped region in the end region can be inserted into the shell-shaped part and can then be fastened in a frictional manner (force-fit) by the fastening device to the connection element.

According to an advantageous embodiment it is proposed that the contact element is configured so that it abuts against a contact area of the connection element lying behind the shell-shaped part of the connection element, when the fastening device fastens in a frictional manner (force-fit) the end region of the round conductor.

The contact element and the round conductor closed with the contact element may for example be configured so that the contact element is pressed against the contact area when the fastening device fastens in a frictional manner (force-fit) the end region of the round conductor in the region of the shell-shaped part of the connection element to the said connection element. Thus, a particularly reliable electrical connection of the contact element with the connection element can be achieved. The contact area can for example be formed flat, as can the underneath side of the contact element, which during the fastening is pressed by the fastening device against the contact area.

The fastening device can thus ensure, due to the frictional type (force-fit) fastening, on the one hand a reliable fastening of the round conductor in the end region to the connection element, wherein at the same time an electrical contact of the round conductor with the contact element is achieved by pressing the contact element against the contact area. The contact element is for example securely connected to the end-side cable of the round conductor, so that a predefined position of the contact element is ensured when the round conductor in the end region is fastened in a frictional manner (force-fit) to the connection element by the fastening device.

According to an advantageous embodiment it is proposed that an insulation surrounds the contact element, the end region of the round cable and the connection element in the region of the contact area and the shell-shaped part of the connection element.

For example, this insulation can be a sprayed-on insulation, but can also be a shrink hose or another suitable insulation.

For example the insulation can be applied before the fastening device is applied and fastened.

For this purpose the shrink hose can for example, as already explained, be slipped over the contact element, the end region of the round cable and the connection element in the region of the contact area and of the shell-shaped part of the connection element, and then shrunk. Thus, the shrink hose can provide an insulation in the region of the contact area and the shell-shaped part of the connection element and also provide an insulation of the contact element of the round cable.

For example, the insulation can also be sprayed over the contact element, the end region of the round cable and the connection element in the region of the contact area and of the shell-shaped part of the connection element.

According to an advantageous embodiment it is proposed that the shell-shaped part of the connection element ends flat.

This flat shaped end of the shell-shaped part may for example be advantageous when using a shrink hose, since damage to the shrink hose is avoided. The flat end can for example also be realised by a bevelled end.

According to an advantageous embodiment it is proposed that the fastening device is a two-part fastening clip, in which the two parts are designed so as to engage by snap-in engagement with one another and in the snap-in engagement at least partially surround the end region of the round conductor and an underneath side of the shell-shaped part of the connection element, and in this way press the round conductor into the shell-shaped part.

For example, the two parts can in the snap-in engagement form a substantially annular fastening clip, which surrounds the end region of the round conductor and the underneath side of the shell-shaped part of the connection element and thus provides for the frictional type (force-fit) fastening. The two parts of the fastening clip may for example be formed of plastic material, but can however also be formed of metal or a metal alloy. The snap-in engagement can be achieved by suitable snap-in elements, which are arranged on the first and/or second part of the fastening clip. These snap-in elements can for example form snap-in hooks or extensions that actively engage with the respective snap-in hooks. Other suitable snap-in elements can however also be used. According to an advantageous embodiment it is proposed that the first part of the fastening clip includes a region in which the first part is configured in such a way as to at least partially embrace, during snap-in engagement, the end region of the round conductor on the side of the round conductor opposite the connection element. For example this region can be C-shaped or U-shaped or V-shaped, or can also have another shape that at least partially corresponds to that of the end region of the round conductor.

According to an advantageous embodiment the second part of the fastening clip comprises a region in which the second part is configured so that, during snap-in engagement, it at least partially embraces the underneath side of the shell-shaped part of the connection element. This region of the second part of the fastening clip can for example be U-shaped or also C-shaped or V-shaped, or can have another shape corresponding at least partially to the end region of the round conductor.

Thus, for example, the first part of the fastening clip can be slipped from above onto the end region of the round conductor, while the second part of the fastening clip can be slipped from below onto the underneath side of the shell-shaped part of the connection element, so that the first part and the second part of the fastening clip engage by snap-in engagement with one another and thereby form a snap-in-engaged fastening clip that embraces the end region of the round conductor and the shell-shaped part of the connection element. The snap-in-engaged fastening clip is in this connection designed so as to exert a pressure on the end region of the round conductor in the direction of the shell-shaped part of the connection element.

According to an advantageous embodiment it is proposed that the second part of the fastening clip comprises a positioning element that cooperates with a complementary positioning element on the underneath side of the shell-shaped part of the connection element, so as to position the second part of the fastening clip.

For example, this positioning element of the second part can be formed as a pin, and the complementary position element on the underneath side of the shell-shaped part can be a corresponding positioning hole. If therefore the second part is slipped onto the underneath side of the shell-shaped part so that the pin is engaged in the hole of the underneath side, then a rotation of the snap-in-engaged fastening clip can thereby be prevented. The pin can also be formed on the underneath side of the shell-shaped part, in which case the complementary hole is then correspondingly formed in the second part of the fastening clip. Other suitable positioning elements can however also be used.

According to an advantageous embodiment it is proposed that the first part of the fastening clip comprises two snap-in elements arranged respectively at one end of the first part, and that the second part of the fastening clip comprises two snap-in elements arranged respectively at one end of the second part, and these snap-in elements are configured in such a way that the first part and the second part of the fastening clip can engage with one another by snap-in engagement on both sides.

For example, a snap-in element of one part of the fastening clip can form a snap-in lug, and a complementary snap-in element of the other part of the fastening clip can form a snap-in hook. Other snap-in elements can however also be used.

Thus, the first part of the fastening clip can be engaged by snap-in engagement with the second part of the fastening clip via the snap-in elements on both sides, whereby the snap-in-engaged fastening clip presses the round conductor in the end region into the part of the connection element.

According to an advantageous embodiment it is proposed that the fastening clip comprises a hinge, which movably connects one end of the first part and one end of the second part of the fastening clip to one another, wherein the first part and the second part respectively comprise a snap-in element, which is arranged on an end of the respective part lying opposite the hinge, and these snap-in elements are configured so that the first part and the second part of the fastening clip can engage by snap-in engagement with one another on one side.

This hinge can for example be formed by a film hinge. Thus, for example, the snap-in engagement of the fastening clip can take place by swivelling the first part with the aid of the hinge and snap-in engagement via the snap-in elements.

According to an advantageous embodiment it is proposed that the first part and the second part of the fastening clip are respectively shell-shaped, wherein the shell-shaped second part is configured so as to grip over two end regions of the shell-shaped first part and become locked in these two end regions.

For example, the internal radius of the shell-shaped second part in the contact region with the first part, i.e. the two end regions of the first part, can be slightly less than the external radius of the first part in these two end regions. The shell-shaped second part can have a certain flexibility, so that the second part expands slightly when slipped over the first part and a particularly secure snap-in engagement with the first part can thereby be achieved. The shell-shaped first part can comprise respectively a snap-in element in each of the two end regions, while the shell-shaped second part comprises on the inside in its two end regions, these end regions being able to be slipped over the corresponding end regions of the shell-shaped first part, respectively a snap-in element complementary to the respective snap-in elements of the shell-shaped first part. The shell-shaped part of the first part and of the second part of the fastening clip respectively can for example be C-shaped, V-shaped, U-shaped or can form another suitable, at least substantially shell-shaped part.

Thus, first of all the first part of the fastening clip can for example be slipped from above onto the end region of the round conductor, followed by the second part of the fastening clip that can be slipped from below over the underneath side of the shell-shaped part, so that the second part of the fastening clip embraces the two end regions of the shell-shaped first part and is securely engaged by snap-in engagement in these regions by the respective snap-in elements. The frictional type (force-fit) fastening of the end region of the round conductor to the shell-shaped part of the connection element is achieved in this way.

According to an advantageous embodiment it is proposed that the fastening device is a compressed metal ring, which embraces the end region of the round conductor and an underneath side of the shell-shaped part of the connection element.

The metal ring is for example slipped onto the round cable and at the same time over the shell-shaped part, so that the slipped-on metal ring embraces the end region of the round cable and the underneath side of the shell-shaped part of the connection element. The metal ring is then compressed, so that the compressed metal ring in the end region of the round cable presses into the shell-shaped part of the connection element. The metal may for example be steel or another metal or an alloy. The compressed metal ring may for example be formed in one part.

According to an advantageous embodiment it is proposed that the fastening device is a spring metal ring, which embraces the end region of the round conductor and an underneath side of the shell-shaped part of the connection element.

The spring metal ring is for example slipped onto the round cable and over the shell-shaped part, whereby the slipped-on spring steel ring presses the end region of the round cable into the shell-shaped part of the connection element. The spring metal ring may be formed in one piece. The spring metal of the spring metal ring may for example also be an alloy.

According to an advantageous embodiment it is proposed that the fastening device comprises a crimping element that clamps around the end region of the round conductor and an underneath side of the shell-shaped part of the connection element.

For example, the crimping element can also be slipped onto the round cable and at the same time over the shell-shaped part of the connection element, so that the slipped-on crimping element embraces the end region of the round cable and the underneath side of the shell-shaped part of the connection element. The crimping element is then crimped, so that the crimped crimping element presses the end region of the round cable into the shell-shaped part of the connection element. The frictional type (force-fit) fastening of the end region of the round cable in the shell-shaped part of the connection element is thus achieved by the crimping of the crimping element.

According to an advantageous embodiment it is proposed that the crimping element is a metal band.

This metal band may for example be an individual isocrimp formed as metal.

According to an advantageous embodiment it is proposed that the crimping element is formed as an O-shaped crimp, a wire crimp or an overlapping crimp.

For example, the wire crimp can be formed of metal, wherein for example an inwardly oriented wire claw is present at each end of the wire crimp, which on crimping produces a claw-like engagement with the insulation of the connection cable in this region. For example, this wire crimp is slipped over the round cable and the underneath side of the shell-shaped part of the connection elements in such a way that the two wire crimps are disposed on the upper side of the round cable, i.e. on the side of the round cable facing away from the shell-shaped part. Thus, the two wire crimps engage like claws for example at the top in the insulation of the connection cable, while simultaneously the lower end region of the round cable is pressed into the shell-shaped part of the connection element.

According to an advantageous embodiment it is proposed that the fastening device comprises a clip that is substantially U-, V- or C-shaped in cross-section, which includes a fastening element at each end, wherein each of the fastening elements is configured so as to embrace, at least partially for a two-sided fastening, an underneath side of the shell-shaped part of the connection element from respectively one side.

The fastening elements of the clip may for example be snap-in elements, and the underneath side of the shell-shaped part of the connection element can have snap-in elements that are complementary to these snap-in elements. For example, the fastening elements of the clip can form snap-in hooks, and the complementary snap-in elements on the underneath side of the shell-shaped part can form receivers for engaged snap-in hooks. However, other snap-in elements and complementary snap-in elements can also be used.

The clip can thus be slipped from above onto the end region of the round conductor, until the fastening elements at least partially embrace the underneath side of the shell-shaped part and there form a snap-in engagement with the underneath side of the shell-shaped part of the connection element. For example, the round conductor in the end region can be stripped in the contact area for the shell-shaped part of the connection element, so that the remaining insulation in the end region of the round conductor is sealed flush with the shell-shaped part of the connection element. The clip can be produced for example from plastic or a metal or from a metal alloy.

The clip can for example correspond to the shell-shaped ring segment described hereinbefore.

According to an advantageous embodiment it is proposed that the fastening device has a metal shell element that is substantially U-, V- or C-shaped in cross-section, which has at both ends respectively an edge region that is complementary to a respective edge region of the shell-shaped part of the connection element, and wherein the metal shell element is engaged by adhesive bonding (material bond) to the respective edge region of the shell-shaped part of the connection element in such a way that the metal shell element and the shell-shaped part form a one-piece ring embracing the end region of the round conductor.

The metal shell element is for this purpose placed for example on the two oppositely facing edge regions of the shell-shaped part so that the metal shell element and the shell-shaped part form a ring surrounding the end region of the round conductor. The metal shell element can thus correspond to the afore-described shell-shaped ring segment.

Following this, a first force is for example exerted on the metal shell element in the direction of the shell-shaped part, while for example at the same time the underneath side of the shell-shaped part is supported, or a force substantially opposite to the first force is exerted on the underneath side of the shell-shaped part. Due to the exerted force or forces, the round conductor in the end region is forced into the shell-shaped part of the connection element.

At the same time each of the two edge regions of the metal shell element, which abut against the respective edge region of the shell-shaped part, are engaged by adhesive bonding (material bond). This can take place for example by welding, soldering, bonding or a similarly suitable method for adhesive bonding (material bond). The now single-piece ring, comprising the metal shell element and the shell-shaped part of the connection element, exerts the cohesive fastening force.

According to an advantageous embodiment it is proposed that the fastening device is a ring that can be closed on one side by a closure device, which is adapted so as to embrace, in the closed state, the end region on the round conductor and an underneath side of the shell- shaped part of the connection element.

The ring closable on one side can for example form a ring having a substantially U-shaped cross-section, which is separated at a point in the cross-section and has there at each end a closure means for the one-sided closure of the ring. These closure means may for example form snap-in closure means. In order to fasten the ring closable on one side this ring is for example slipped in the open state onto the round cable and at the same time over the shell-shaped part, so that the slipped-on ring embraces the end region of the round cable and the underneath side of the shell-shaped part of the connection element. The ring is then closed by the closure means, so that the closed ring presses the end region of the round cable into the shell-shaped part of the connection element. For this purpose the ring is for example pressed together with a certain force, against the resistance of the ring, until the closure means closes the ring on one side and produces the frictional type (force-fit) fastening.

The ring may be formed for example of plastic or of metal or a metal alloy. The ring closable on one side may be formed in one piece.

The aforementioned exemplary embodiments can, so far as is technically feasible, be combined in all variants with one another, and in particular individual features of different embodiments can also be combined together with one another.

The object and the method are described in more detail hereinafter with the aid of figures illustrating exemplary embodiments.

Figure 2A:
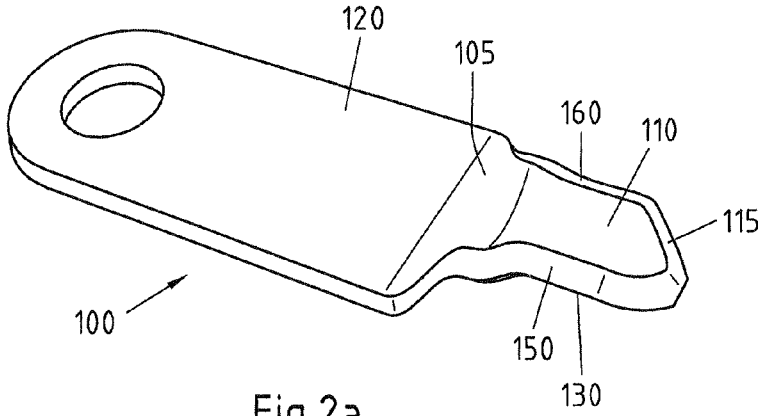
Figure 2B:
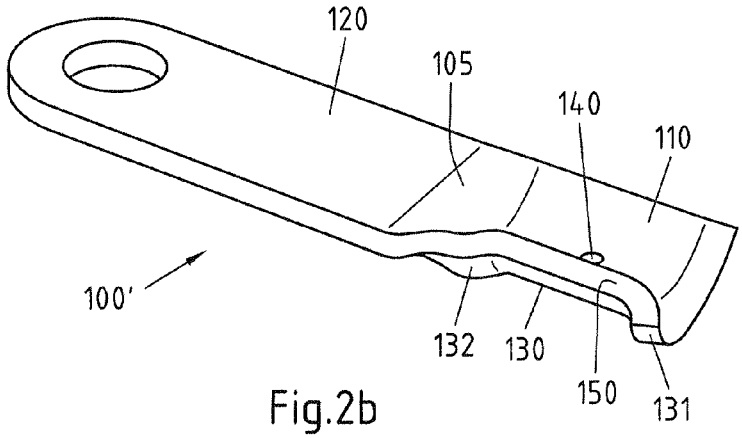
Figure 2C:
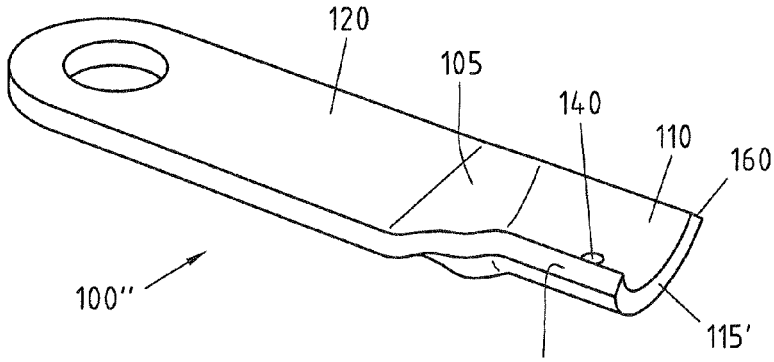
Figure 2D:
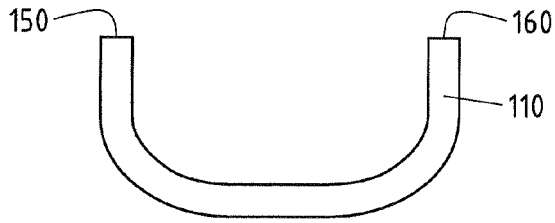
Figure 2E:
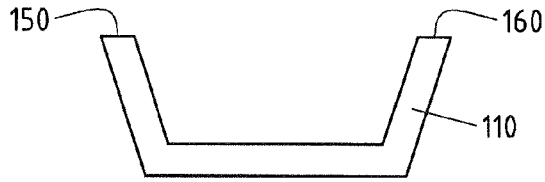
Figure 2F:
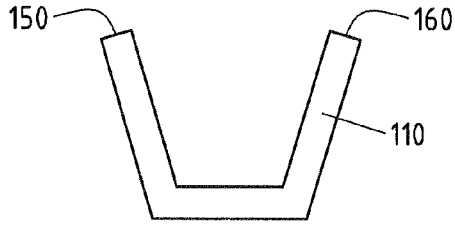
Figure 3A:
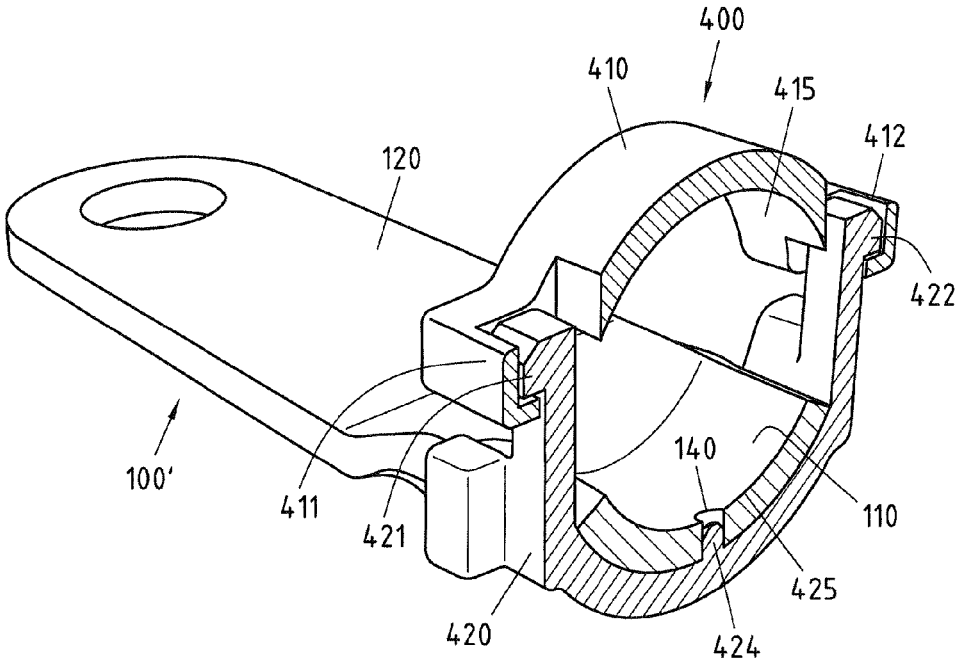
Figure 3B:
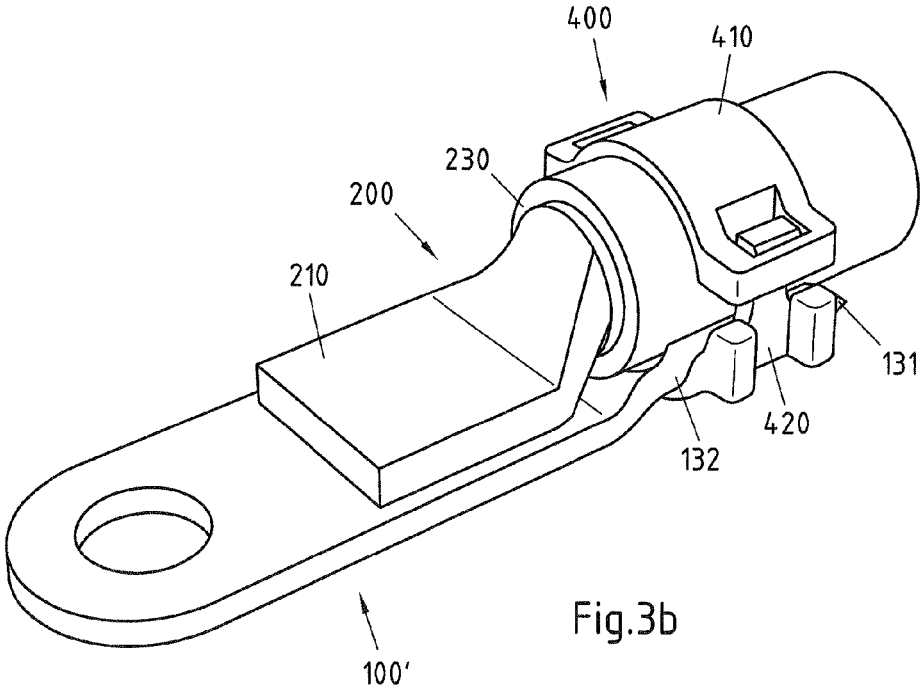
Figure 3C:
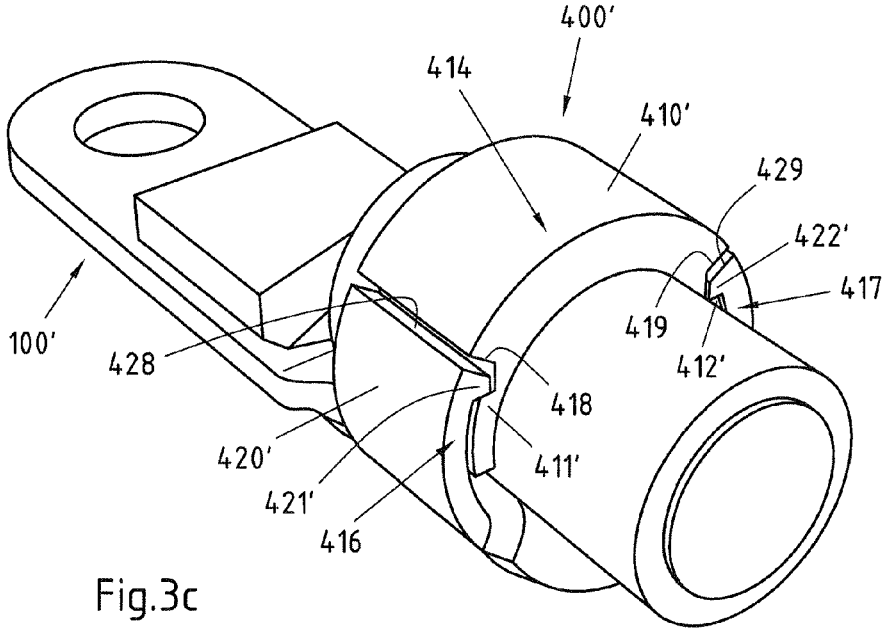
Figure 4A:
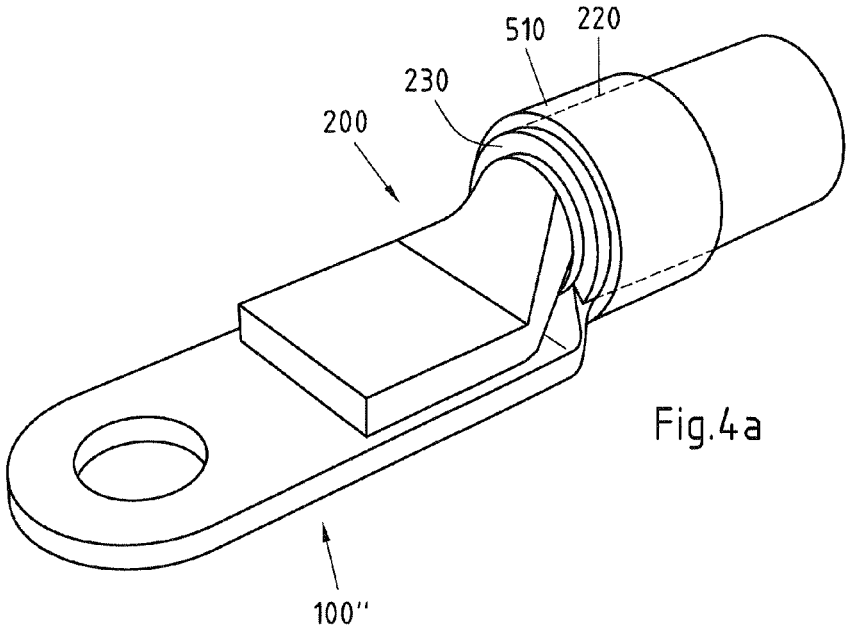
Figure 4B:
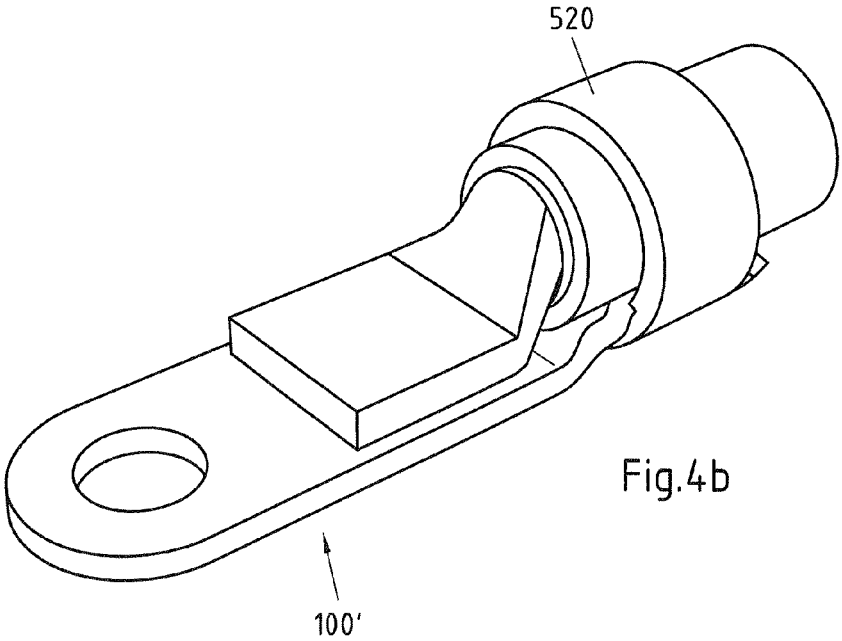
Figure 5A:
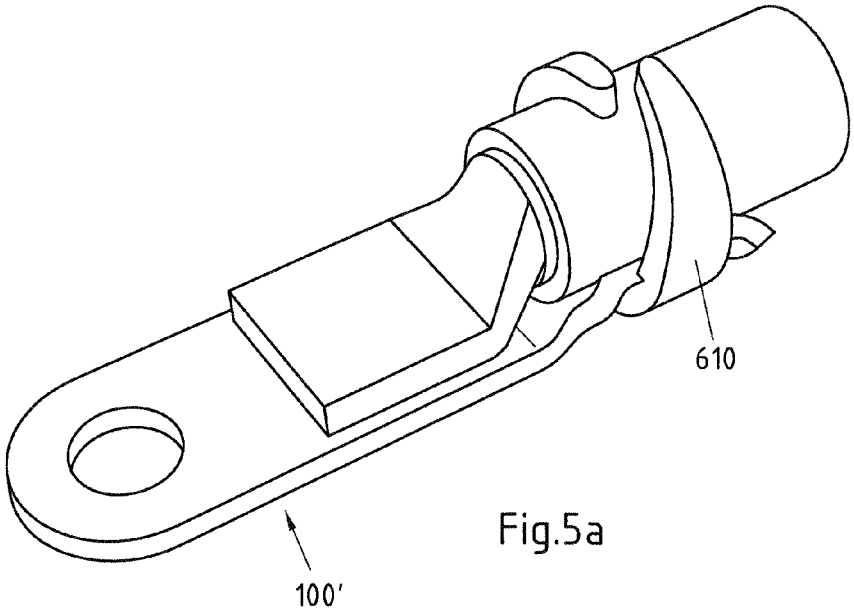
Figure 5B:
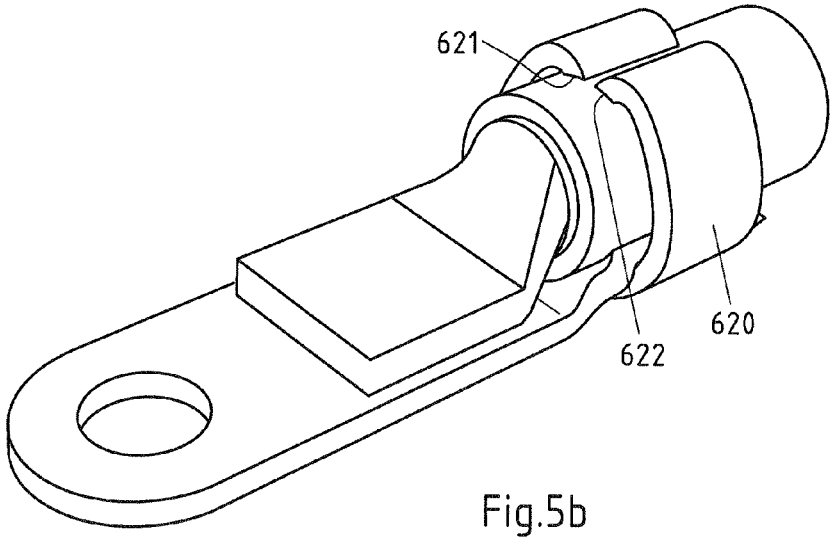
Figure 6A:
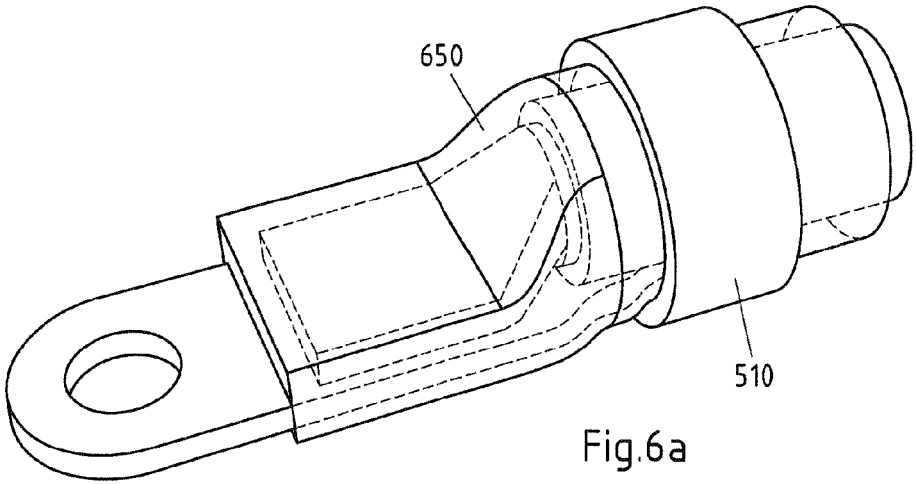
Figure 6B:
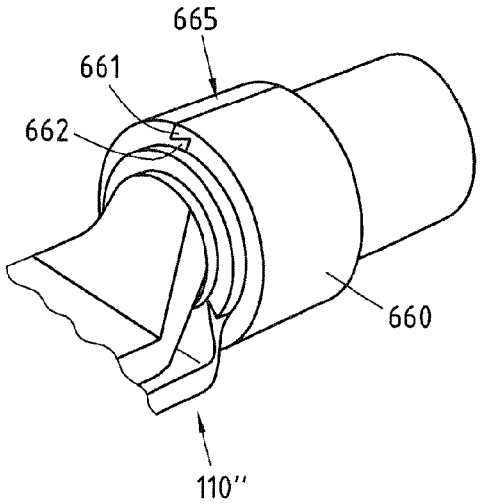
Figure 6C:
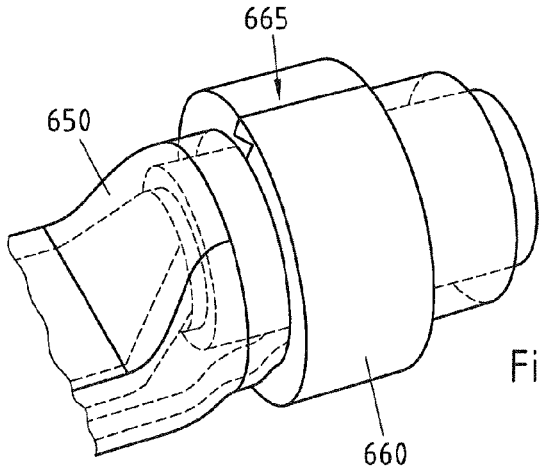
Figure 7:
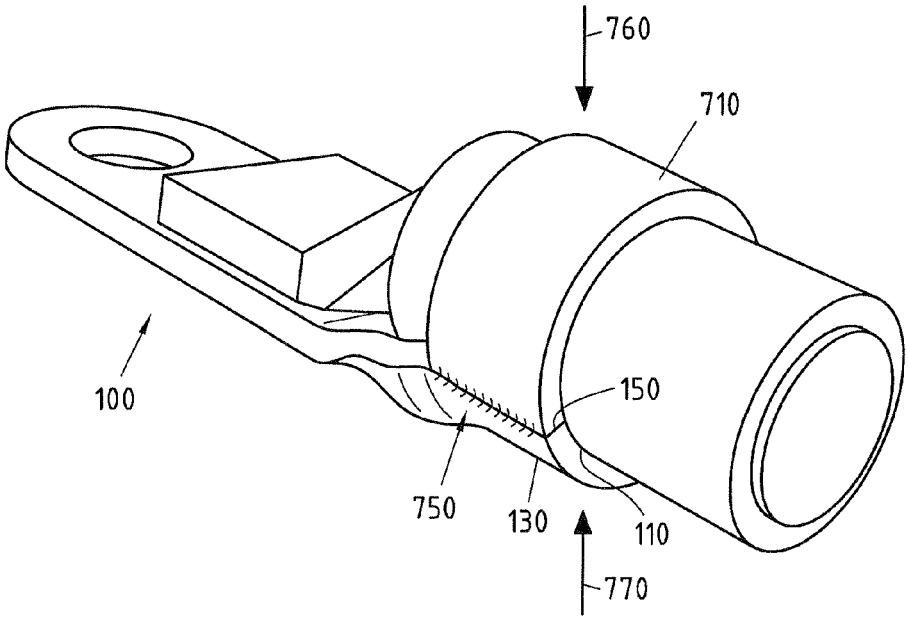
Figure 8A:
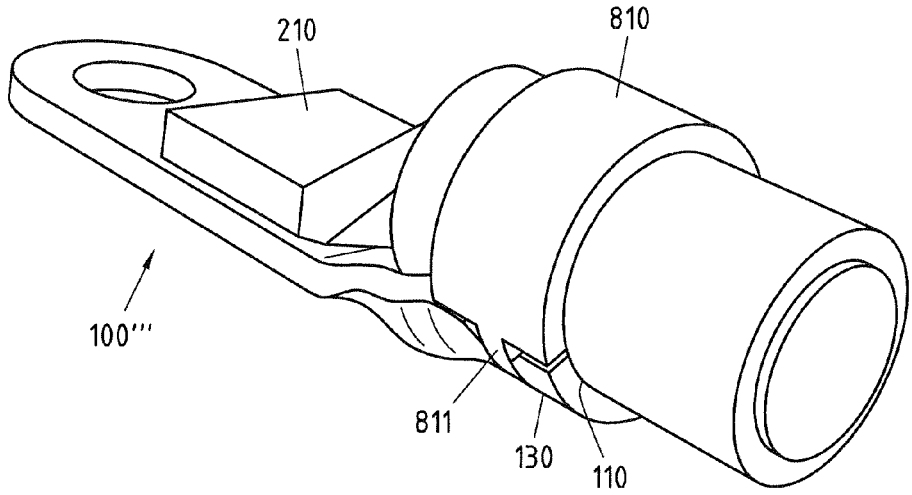
Figure 8B:
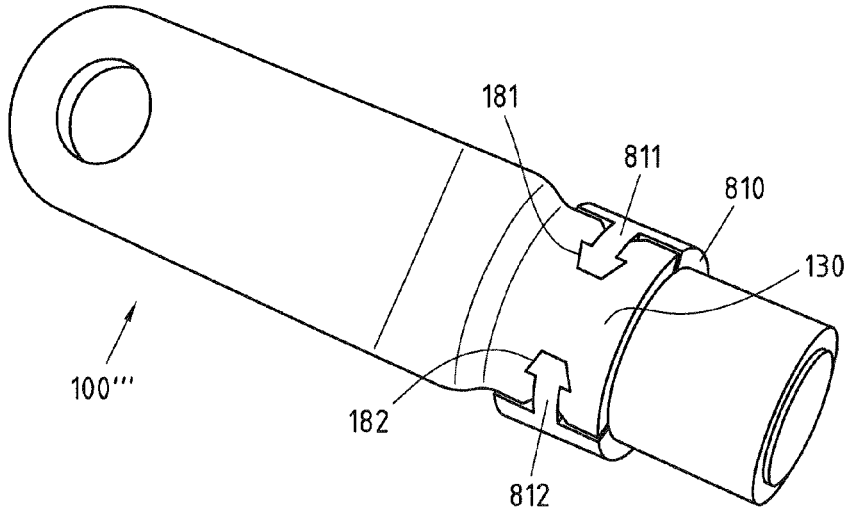

In the Figures:

FIG. 1 shows an exemplary system according to a first embodiment;

FIG. 2*a* shows an exemplary connection element according to a first embodiment;

FIG. 2*b* shows an exemplary connection element according to a second embodiment;

FIG. 2*c* shows an exemplary connection element according to a third embodiment;

FIG. 2*d* shows a cross-section of an exemplary shell-shaped part according to a first embodiment;

FIG. 2*e* shows a cross-section of an exemplary shell-shaped part according to a second embodiment;

FIG. 2*f* shows a cross-section of an exemplary shell-shaped part according to a third embodiment;

FIG. 3*a* shows an exemplary system according to a second embodiment in a first representation;

FIG. 3*b* shows an exemplary system according to a second embodiment in a second representation;

FIG. 3*c* shows an exemplary system according to a third embodiment;

FIG. 4*a* shows an exemplary system according to a fourth embodiment;

FIG. 4*b* shows an exemplary system according to a fifth embodiment;

FIG. 5*a* shows an exemplary system according to a sixth embodiment;

FIG. 5*b* shows an exemplary system according to a seventh embodiment;

FIG. 6*a* shows an exemplary system according to an eighth embodiment;

FIG. 6*b* shows an exemplary system according to a ninth embodiment;

FIG. 6*c* shows an exemplary system according to a tenth embodiment;

FIG. 7 shows an exemplary system according to an eleventh embodiment;

FIG. 8*a* shows an exemplary system according to a twelfth embodiment in a first representation; and FIG. 8*b* shows an exemplary system according to a twelfth embodiment in a second representation.

An exemplary system for fastening a round conductor 200 to a connection element 100 is shown in FIG. 1. The round conductor 200 is closed with a contact element 210. Furthermore the round conductor 200 can have an optional insulation 230. The contact element 210 is adapted so as to be electrically connected to the connection element 100.

The connection element 100 comprises an at least partially shell-shaped part 110. This at least partially shell-shaped part 110 is configured in such a way that a suitably corresponding part of an end region 220 of the round conductor 200, lying in front of the contact element 210, can be accommodated when the end region 220 of the round conductor 200 is positioned in the at least partially shell-shaped part 110 of the connection element 100. The connection element 100 may consist for example of aluminium or of copper, or of another conducting material, for example an alloy. The connection element 100 may be formed in one piece. The connection element 100 may for example form a cable lug for receiving the round cable 200.

In addition the system comprises a fastening device (not shown in FIG. 1), which is adapted to fasten in a frictional manner (force-fit) the end region 220 of the round conductor 200, lying in front of the contact element 210, in the region of the shell-shaped part 110 of the connection element 100 to the connection element 100. This frictional type (force-fit) fastening is represented in FIG. 1 for example by the arrow 300. In the system illustrated by way of example in FIG. 1, the underneath side of the round conductor 200 is joined in a frictional manner (force-fit) in the end region 220 to the shell-shaped part 110 of the connection element 100. The shell-shaped part 110 of the connection element 100 can be shaped corresponding to the roundness of the round conductor 200 in the end region 220.

By means of the frictional type (force-fit) fastening of the end region 220 of the round conductor 200 to the connection element 100 in the region of the shell-shaped part 110 of the connection element 100, on the one hand a secure fastening of the round conductor 200 to the connection element 100 is achieved, and on the other hand the contact element 210 is brought into a predefined position in relation to the connection element 100 and is held in this predefined position by the frictional type (force-fit) fastening. A simple electrical contact of the contact element 210 with the connection element 100 can thus take place.

For example, the contact element 210 can be configured so that the contact element 210 abuts a contact area 120 of the connection element 120 lying behind the shell-shaped part 110 of the connection element 100, when the fastening device fastens the end region 220 of the round conductor 200 in a frictional manner (force-fit). The contact element 210 and the round conductor 200 closed with the contact element 210 may for example be configured in such a way that the contact element 210 is pressed onto the contact area 120 when the fastening device fastens in a frictional manner (force-fit) the end region 220 of the round conductor 200 in the region of the shell-shaped part 110 of the connection element 100, to the connection element 100. A particularly secure electrical connection of the contact element 210 with the connection element 100 can thus be achieved. The contact area 120 can for example be formed flat, as can the underneath side of the contact element 220. In addition the connection element 100 can for example be formed substantially flat except for the shell-shaped part 110. For example, the contact element 210 can be formed as a flat part, and the connection element 100 in the region of the contact area 120 can be formed as a flat part.

The connection element 100 can for example have a step 105, or edge 105, or end wall 105, in a transition region between the shell-shaped part 110 and the contact area 120 for the contact element 210, which delimits the shell-shaped part 110 in the transverse direction of the round cable 200 laid in the shell-shaped part. The end of the end region 220 of the round cable 200 can thus be fixed in the transverse direction by this step 105 or edge 105 or end wall 105, when the round cable 200 in the end region 220 is inserted into the shell-shaped parts.

The connection element 100 may for example be a connection element for a vehicle electrical circuit, in which a round conductor 200 is to be connected to the electrical circuit via the connection element 100.

The fastening device may be any suitable fastening device for the aforedescribed frictional type (force-fit) connection. For this purpose various exemplary possible realisations are illustrated hereinafter, which however are not to be understood as restrictive.

FIG. 2*a* shows an exemplary connection element 100 according to a first embodiment, which is based on the connection element 100 previously illustrated in FIG. 1. The exemplary connection element illustrated in FIG. 2*a* has at the end of the shell-shaped part 110 a bevelled mouth portion 115, which adjoins the two edge regions 150, 160 of the shell-shaped part 110. This bevelled mouth portion 115 may for example be advantageous when using a shrink hose casing.

FIG. 2*b* shows an exemplary connection element 100' according to a second embodiment. In the connection element 100' the underneath side 130 of the shell-shaped part is bounded respectively by a bead 131, 132. The beads 131, 132 may for example be advantageous for positioning the fastening device.

Furthermore the exemplary connection element 100' can also comprise an optional positioning element 140, which in FIG. 2 is formed as a recess 140, for example a hole.

FIG. 2*c* shows an exemplary connection element 100" according to a third embodiment. This connection element 100" has a flat end portion 115' of the shell-shaped part 110. This flat end portion 115 may for example be advantageous when using a shrink hose.

FIG. 2*d* shows a cross-section of an exemplary shell-shaped part 110 according to a first embodiment. The cross-section of this shell-shaped part 110 is essentially C-shaped. The C shell-shaped part 110 terminates on both sides with the respective edge region 150, 160, which lie opposite one another.

FIG. 2*e* shows a cross-section of an exemplary shell-shaped part 110 according to a second embodiment. The cross-section of this shell-shaped part 110 is substantially U-shaped.

FIG. 2*f* shows a cross-section of an exemplary shell-shaped part 110 according to a third embodiment. The cross-section of this shell-shaped part 110 is essentially V-shaped.

The illustrated cross-sections should be understood only as examples. Thus, for example, the opening angles of the shapes can differ. For example, the C-shaped configurations also include closed shell-shaped parts, in which the shell-shaped part is more than 180° in cross-section, or open shell-shaped parts, in which the shell-shaped part is less than 180° in cross-section. This applies appropriately also to the other illustrated cross-sections. The aforementioned explanations regarding the exemplary cross-sections refer not only to the configuration of the shell-shaped part 110, 100', 100", but can also be applied to other features in the description, such as for example parts of the fastening device.

FIG. 3*a* shows an exemplary system according to a second embodiment in a first representation, which is explained in conjunction with the second representation of the second embodiment illustrated in FIG. 3*b*.

The fastening device 400 in this second embodiment is a fastening clip 400 comprising two parts 410, 420, wherein the two parts 410, 420 are adapted so as to engage by snap-in engagement with one another, and during the snap-in engagement to embrace at least partially the end region 220 of the round conductor 200 and an underneath side 130 of the shell-shaped part 110 of the connection element 100', and thereby press the round conductor 200 in the end region 220 in the region of the shell-shaped part 110 into the connection element 100'.

The first part 410 of the fastening clip 400 comprises a region 415, in which the first part 410 is configured so as to at least partially surround by snap-in engagement the end region 220 of the round conductor 200 on the side of the round conductor 200 opposite the connection element 100, as is illustrated by way of example in FIG. 3*b*. The first part 410 of the fastening clip 400 may for example be C-shaped, as illustrated in FIGS. 3*a* and 3*b*, or also U-shaped or V-shaped, or have another shape corresponding at least partially to the end region 220 of the round conductor 200.

The second part 420 of the fastening clip 400 comprises a region 425, in which the second part 420 is configured so as to at least partially embrace by snap-in engagement the underneath side 130 of the shell-shaped part 110 of the connection element 100. The second part 420 of the fastening clip 400 may for example be U-shaped, as illustrated in FIGS. 3*a* and 3*b*, or also C-shaped or V-shaped, or may have another shape corresponding at least partially to the end region 220 of the round conductor 200.

In addition the connection element 100' may include the previously described beads 131, 132, which are arranged so that the second part 420 of the fastening clip 400 is positioned on both sides by means of the beads 131, 132. A sideways slipping of the fastening clip 400 can be avoided in this way.

Furthermore the connection element 100' may comprise the aforedescribed positioning element 140, which in this example is a hole 140. The second part 420 of the fastening clip 400 comprises a positioning element 424 complementary to the positioning element 140, which may for example be a pin 424. The pin 424 is arranged in such a way in the region 425 of the second part 420 that the pin 425, when this region 425 of the second part 420 at least partially embraces the underneath side 130 of the shell-shaped part 110, is inserted in the hole 140 and thereby prevents a rotation of the fastening clip.

The first part 410 of the fastening clip 400 comprises two snap-in elements 411, 412 arranged respectively at one end of the first part 410, and the second part 420 of the fastening clip comprises two snap-in elements 421, 422 arranged respectively at one end of the second part 420, and these snap-in elements 411, 412, 421, 422 are configured so that the first part 410 and the second part 420 of the fastening clip 400 can engage by snap-in engagement with one another on both sides.

For example, a snap-in element 421 of a part 420 of the fastening clip 400 can form a snap-in hook 421, and the complementary snap-in element 411 of the other part 410 can form a snap-in hook receiver 411, as illustrated by way of example in FIG. 3*a*. Other snap-in elements may however also be formed.

Thus, the first part 410 of the fastening clip 400 can be engaged by snap-in engagement on both sides with the second part 420 of the fastening clip over the snap-in elements 411, 412, 421, 422 on both sides, whereby the snap-in engaged fastening clip 400 presses the round conductor 200 in the end region 220 into the shell-shaped part 110 of the connection element 100'.

For example, the fastening clip 400 according to the second exemplary embodiment can also comprise a hinge (not shown), which movably connects one end of the first part 410 and one end of the second part 420 of the fastening clip to one another. For example the snap-in elements 411 and 421 can be replaced by this hinge, which may for example be a film hinge. The first part 410 and the second part 420 comprise respectively a snap-in element 412, 422, which are arranged on an end of the respective part 410, 420 lying opposite the hinge, these snap-in elements 412, 422 being configured so that the first part 410 and the second part 420 of the fastening clip 400 can engage in by snap-in engagement with one another on one side. Thus, for example, the snap-in engagement of the fastening clip 400 can take place by rotating the first part 410 with the aid of the hinge and snap-in engagement by means of the snap-in elements 412, 422.

The fastening clip, i.e. in this embodiment the first part 410 and the second part 420, may for example be formed of plastic, but may also for example be formed of metal or a metal alloy.

FIG. 3*c* shows an exemplary system according to a third embodiment, which again comprises a fastening clip 400' with a first part 410' and a second part 420', wherein the first part 410' and the second part 420' of the fastening clip 400' are in each case shell-shaped, and the shell-shaped second part 420' is configured so as to grip by snap-in engagement over two end regions 416, 417 of the shell-shaped first part 410'.

For example the internal radius of the shell-shaped second part 420' in the contact region with the first part 410', i.e. the oppositely facing end regions 416, 417 of the first part 410', may be somewhat smaller than the external radius of the first part 410' in the end regions 416, 417, wherein the material of the second part 420' has a flexibility such that the second part 420' can expand so as to be slipped over the first part 410'.

In addition the middle region 414 of the second part 410' lying between the two end regions 416, 417 can have a larger external radius, so that a step 418, 419 is formed between the middle region 414 and the respective end regions 416, 417, which step separates the middle region 414 from the end regions 416, 417 and serves as a boundary for an edge region 428, 429 of the respective end of the second part 420' of the fastening clip, so that the second part 420' when slipped onto the first part 410' abuts with the respective end region 428, 429 against the respective step 418,419 and is positioned. These steps 418, 419 may for example also be formed by a bead.

Furthermore the first part may comprise snap-in elements 411', 412', which can engage by snap-in engagement with complementary snap-in elements 421', 422' of the second part 420' when the second part 420' of the fastening clip 400' is slipped over the first part 410' of the fastening clip 400. The snap-in elements 411', 412' of the first part 410' may for example form snap-in hook recesses 411', 412', and the snap-in elements 421', 422' of the second part 420' may form snap-in hooks 421', 422', or vice versa.

FIG. 4*a* shows an exemplary system according to a fourth embodiment, in which the fastening device is a spring metal ring 510, which embraces the end region 220 of the round conductor and the underneath side 130 of the connection element 100". The spring metal ring 510 is for example slipped onto the round cable 200 and over the shell-shaped part 110, whereby the slipped-on spring steel ring presses the end region 220 of the round cable 200 into the shell-shaped part 110 of the connection element 110". The spring metal ring 510 can be formed in one piece.

For example, the insulation 230 of the round conductor 200 is stripped in a region in which the round conductor 200 abuts against the shell-shaped part 110 of the connection element 100" in the case where fastening is effected by the spring metal ring, as is illustrated by way of example in FIG. 4*a*. Thus, for example, the edge areas 150, 160 of the shell-shaped part adjoin the remaining insulation 230 in the end region 220 of the round conductor 200. For example the underneath side 130 of the shell-shaped part can be configured so that the underneath side 130 and the remaining insulation 230 in the end region 220 of the round conductor 200 are substantially circular in cross-section. The spring metal ring can thus abut uniformly against the underneath side 130 and the remaining insulation 230 in the end region of the round conductor 200. The spring metal ring may for example be a spring steel ring, and the spring metal may also be an alloy.

FIG. 4*b* shows an exemplary system according to a fifth embodiment, in which the fastening device is a pressed metal ring 520 that surrounds the end region 220 of the round conductor and the underneath side 130 of the connection element 110'. The metal ring 520 is for example slipped onto the round cable 200 and over the shell-shaped part 110, so that the slipped-on metal ring 520 embraces the end region 220 of the round cable 200 and the underneath side 130 of the shell-shaped part 110 of the connection element 100'. The metal ring 520 is then pressed, so that the pressed metal ring forces the end region 220 of the round cable into the shell-shaped part 110 of the connection element 110'. The metal may for example be steel or another metal or an alloy. The pressed metal ring 520 may be formed in one piece.

FIG. 5*a* shows an exemplary system according to a sixth embodiment. In this sixth embodiment, as also in the seventh embodiment illustrated in FIG. 5*b*, a crimping element 610, 620 is used as fastening device, wherein the crimping element 610, 620 is slipped onto the round cable 200 and over the shell-shaped part 110, so that the slipped-on crimping element 610, 620 embraces the end region 220 of the round cable 200 and the underneath side 130 of the shell-shaped part 110 of the connection element 100'. The crimping element 610, 620 is then crimped, so that the crimped crimping element 610, 620 forces the end region 220 of the round cable 200 into the shell-shaped part 110 of the connection element 110'.

As is illustrated by way of example in FIG. 5*a*, the crimping element 610 may be a metal band 610, for example an individual isocrimp formed as metal. As is illustrated by way of example in FIG. 5*b*, the crimping element 620 may also be a wire crimp 620 formed of metal, which for example comprises at each end at least one wire claw 621, 622 for the claw-type engagement with the insulation 230 of the connection cable 200.

An O-crimp or an overlapping crimp may for example also be used as crimping element 610, 620.

FIG. 6*a* shows an exemplary system according to an eighth embodiment, wherein the fastening device 410 is the spring metal ring 510 of FIG. 4*a*. The pressed metal ring 520 of FIG. 4*b* may however also be used. Accordingly one of the various connection elements 100, 100' and 100" may be used.

Before the respective metal ring 510 is slipped over the round cable 200 and the shell-shaped part 110, an insulation 650 may for example be applied over the contact element 210, the end region 220 of the round cable 200, and the connection element 100" in the region of the contact area 120 and of the shell-shaped part 110 of the connection element 100. Thus, the insulation 650 embraces the contact element 210, the end region 220 of the round cable 200 and the connection element 100" in the region of the contact area 120 and of the shell-shaped part 110 of the connection element 100" and provides an insulation there.

For example, the insulation can be sprayed on, or can also be a shrink hose that is slipped on, or some other suitable insulation.

The slipped on spring metal ring 510 or pressed metal ring 520 respectively presses the end region 220 of the round cable 200 embracing the insulation 650 into the shell-shaped part 110 of the connection element 100".

FIG. 6*b* shows an exemplary system according to a ninth embodiment, in which the fastening device 660 is a ring 660 closable on one side.

This ring 660 is adapted so as to embrace the end region 220 of the round conductor 200 and the underneath side 130 of the shell-shaped part 110 of the connection element 100" in the closed state, as illustrated in FIG. 6*b*. The ring 660 closable on one side may for example be a ring 660 that is substantially O-shaped in cross-section, which is separated in cross-section at a point 665, and there comprises at each end a closure means 661, 662 for the one-sided closure of the ring 660. These closure means 661, 662 may for example form snap-in elements 661, 662, as illustrated in FIG. 6*b*. In order to fasten the ring 660 closable on one side, this ring 660 is slipped, for example in the open state, onto the round cable 200 and over the shell-shaped part 110, so that the slipped-on ring 620 embraces the end region 220 of the round cable 200 and the underneath side 130 of the shell-shaped part 110 of the connection element 110". The ring 660 is then closed by the closure means 661, 662, so that the closed ring 660 presses the end region 220 of the round cable 200 into the shell-shaped part 110 of the connection element 110'. For this purpose the ring 660 is for example pressed together with a specific force, against the resistance of the ring, until the closure means 661, 662 close the ring on one side.

FIG. 6*c* shows an exemplary system according to a tenth embodiment, which shows the closable ring 660 known from FIG. 6*b* in combination with an applied insulation. The insulation 650 can, as previously explained with regard to the eigth embodiment, be applied over the contact element 210, the end region 220 of the round cable 200, and the connection element 100" in the region of the contact area 120 and of the shell-shaped part 110 of the connection element 100", before the closable ring 660 is slipped on.

FIG. 7 shows an exemplary system according to an eleventh embodiment, in which the fastening device comprises a metal shell element 710 with a U-, V- or C-shaped cross-section, which at both open ends comprises respectively an edge region that is complementary to a respective edge region 150, 160 of the shell-shaped part 110 of the connection element 100, and wherein the metal shell element 710 is connected by adhesive bonding (material bond) 750 to the respective edge region of the shell-shaped part of the connection element so that the metal shell element 710 and the shell-shaped part 110 form a one-piece ring embracing the end region 220 of the round conductor 200.

The metal shell element 710 is for this purpose placed for example on the two oppositely facing edge regions 150, 160 of the shell-shaped part 110 so that the metal shell element 710 and the shell-shaped part 110 form a ring embracing the end region 220 of the round conductor 200. A first force 760 is then for example exerted on the metal shell element 710 in the direction of the shell-shaped part 110, while at the same time the underneath side 130 of the shell-shaped part 110 is supported or a force 770 acting substantially opposite to the first force 760 is exerted on the underneath side 130 of the shell-shaped part 110, as is illustrated for example in FIG. 7. Due to the exerted force or forces, the round conductor 200 in the end region 220 is pressed into the shell-shaped part 110. At the same time each of the two edge regions of the metal shell elements 760, which abut against the respective edge region 150, 160 of the shell-shaped part, are joined to one another by adhesive bonding (material bond). This may be carried out for example by welding, soldering, bonding or by another suitable means. The now one-piece ring, comprising the metal shell element 710 and the shell-shaped part 110 of the connection element 100, exerts the frictional fastening force (force-fit).

FIG. 8*a* shows an exemplary system according to a twelfth embodiment in a first representation, which is explained in conjunction with the second representation of the twelfth embodiment illustrated in FIG. 8*b*.

The fastening device forms a clip 810 that is substantially C-shaped in cross-section, which includes at each end a fastening element 811, 812, wherein each of the fastening elements 811, 812 is configured so as to embrace, at least partially for a two-sided fastening, the underneath side 130 of the shell-shaped part 110 of the connection element 100''' from respectively one side. This embracing of the underneath side 130 of the shell-shaped part 110 by the fastening elements 811, 812 is shown by way of example in FIG. 8*b*. The clip 810 may also have another shape, for example may be substantially U-shaped or V-shaped in cross-section.

The fastening elements 811, 812 of the clip 810 may for example be snap-in elements 811, 812, and the underneath side 130 of the shell-shaped part 110 of the connection element 100''' can have snap-in elements 181, 182 complementary to these snap-in elements 811, 812. For example, the fastening elements 811, 812 of the clip 810 can form snap-in hooks 811, 812, and the complementary snap-in elements 181, 182 on the underneath side 130 of the shell-shaped part 110 can form indented snap-in hook receivers 181, 182. Other snap-in elements and complementary snap-in elements may also be used.

The clip 810 that is substantially U- or V- or C-shaped in cross-section may have a shape such that the clip 810 fastened on the shell-shaped part 110 by the fastening elements 811, 812 forms a two-piece ring embracing the end region 220 of the round conductor 200, which presses the round conductor 200 in the end region 220 into the shell-shaped part 110 and provides the frictional (force-fit) engagement. The clip 810 can thus form a clip-engaged ring 810. The clip 810 may be formed of a suitable metal or also of plastic.

The connection element 100''' may be based on any of the previously described connection elements 100, 100', 100".

The previously mentioned embodiments can, so far as is technically feasible, be combined in all possible variants with one another, and in particular also individual features of different embodiments can be combined with one another.

The invention claimed is:

1. System for fastening a round conductor to a connection element, comprising;

a connection element, which at one end comprises an at least partially shell-shaped part, a round conductor closed with a contact element , wherein the contact element is adapted for contacting the connection element, and a fastening device, which is adapted to fasten an end region completing the round conductor with respect to the contact element in a frictional manner in the region of the shell-shaped part of the connection element to the connection element wherein the fastening device is arranged to embrace at least partially the end region of the round conductor and an underneath side of the shell-shaped part of the connection element.

2. System according to claim 1, wherein the insulation of the round conductor is stripped in a region in which the round conductor abuts, in the case where fastening is performed by the fastening device, against the shell-shaped part of the connection element.

3. System according to claim 1, wherein the contact element is configured so that it abuts against a contact area of the connection element facing the connection element at the shell-shaped part of the connection element, when the fastening device fastens the end region of the round conductor in a frictional manner.

4. System according to claim 3, wherein the contact element is formed as a flat part and the connection element in the region of the contact area is formed as a flat part.

5. System according to claim 1, wherein an insulation surrounds the contact element, the end region of the round cable and the connection element in the region of the contact area and of the shell-shaped part of the connection element.

6. System according to claim 1, wherein the shell-shaped part of the connection has a flat end portion.

7. System according to claim 1, wherein the fastening device at least partially embraces the round conductor in the end region.

8. System according to claim 1, wherein the shell-shaped part is configured so as to fix the round conductor in the longitudinal direction.

9. System according to claim 1, wherein the fastening device is a fastening clip comprising two parts, wherein the two parts are adapted so as to engage by snap-in engagement with one another and, during snap-in engagement, to embrace at least partially the end region of the round conductor and an underneath side of the shell-shaped part of the connection element, and thereby press the round conductor in the end region into the shell-shaped part.

10. System according to claim 9, wherein the first part of the fastening clip comprises a region in which the first part is configured so as during snap-in engagement to at least partially embrace the end region of the round conductor on the side of the round conductor opposite the connection element, and the second part of the fastening clip comprises a region in which the second part is configured so as during snap-in engagement to at least partially embrace the underneath side of the shell-shaped part of the connection element.

11. System according to claim 9, wherein the second part of the fastening clip comprises a positioning element that cooperates with a complementary positioning element on the underneath side of the shell-shaped part of the connection element for the positioning of the second part of the fastening clip.

12. System according to claim 9, wherein the first part of the fastening clip comprises two snap-in elements arranged respectively at one end of the first part, and the second part of the fastening clip comprises two snap-in elements arranged respectively at one end of the second part, and these snap-in elements are configured so that the first part and second part of the fastening clip can engage by snap-in engagement with one another on both sides.

13. System according to claim 9, wherein the fastening clip comprises a hinge, which movably joins together one end of the first part and one end of the second part of the fastening clip, wherein the first part and the second part comprise respectively a snap-in element, which are arranged on an end of the respective part lying opposite the hinge, and these snap-in elements are configured so that the first part and the second part of the fastening clip can engage by snap-in engagement with one another on one side.

14. System according to claim 9, wherein the first part and the second part of the fastening clip are respectively shell-shaped, wherein the shell-shaped second part is configured so as during snap-in engagement to grip over two end regions of the shell-shaped first part, wherein the snap-in-engaged fastening clip embraces the end region of the round conductor and the underneath side of the shell-shaped part of the connection element.

15. System according to claim 1, wherein the fastening device is a pressed metal ring, which embraces the end region of the round conductor and an underneath side of the shell-shaped part of the connection element.

16. System according to claim 1, wherein the fastening device is a spring metal ring which embraces the end region of the round conductor and an underneath side of the shell-shaped part of the connection element.

17. System according to claim 1, wherein the fastening device, comprises a crimping element that clamps around the end region of the round conductor and an underneath side of the shell-shaped part of the connection element.

18. System according to claim 17, wherein the crimping element is a metal band.

19. System according to claim 17, wherein the crimping element is formed as an O-crimp, wire crimp, or overlapping crimp.

20. System according to claim 1, wherein the fastening device comprises a clip that has a substantially U-shaped, V-shaped or C-shaped cross-section, which comprises at each end a fastening element, wherein each of the fastening element is configured so as to embrace at least partially for a two-sided fastening, an underneath side of the shell-shaped part of the connection element, from respectively one side.

21. System according to claim 20, wherein fastening elements of the clip are snap-in elements, and the underneath side of the shell-shaped part of the connection element has snap-in elements that are complementary to these snap-in elements.

22. System according to claim 1, wherein the fastening device is a ring closable on one side by a closure device, which is adapted so as to embrace in the closed state the end region of the round conductor and an underneath side of the shell-shaped part of the connection element.

23. System for fastening a round conductor to a connection element, comprising:

a connection element, which at one end comprises an at least partially shell-shaped part, a round conductor closed with a contact element, wherein the contact element is adapted for contacting the connection element, and a fastening device, which is adapted to fasten in a frictional manner an end region of the round conductor lying in front of the contact element in the region of the shell-shaped part of the connection element to the connection element wherein the fastening device comprises a metal shell element formed substantially U-, V- or C-shaped in cross-section, which at the two open ends has respectively an edge region that is complementary to a respective edge region of the shell-shaped part of the connection element, and wherein the metal shell element is connected by adhesive bonding in such a way to the respective edge region of the shell-shaped part of the connection element that the metal shell element and the shell-shaped part form a one-piece ring embracing the end region of the round conductor.

24. Method for fastening a round conductor closed by a contact element to a connection element, wherein the contact element is adapted for contacting the connection element and the connection element comprises at one end an at least partially shell-shaped part by means of a fastening device , comprising positioning an end region of the round conductor lying in front of the contact element in the shell-shaped part of the connection element; and fastening the end region of the round conductor in a frictional manner to the connection element in the region of the shell-shaped part of the connection element by means of a fastening device, wherein the fastening device is positioned at least partially about the end region of the round connector and an underneath side of the connection element.

* * * * *